United States Patent [19]

Ennes

[11] 4,434,834

[45] Mar. 6, 1984

[54] VERTICAL LOUVER SYSTEM

[76] Inventor: John P. Ennes, 43761 Mandarin Dr., Hemet, Calif. 92343

[21] Appl. No.: 293,447

[22] Filed: Aug. 17, 1981

[51] Int. Cl.[3] ..... E06B 9/26

[52] U.S. Cl. ..... 160/166 A; 160/236

[58] Field of Search ..... 160/166 A, 168, 173, 160/177, 178 R, 236, 264

[56] References Cited

U.S. PATENT DOCUMENTS

| | | | |
|---|---|---|---|
| 2,074,482 | 3/1937 | Martens | 160/236 |
| 2,142,629 | 1/1939 | Clark, Jr. | 160/173 |
| 2,143,382 | 1/1939 | Martens | 160/264 |
| 2,169,873 | 8/1939 | Clark, Jr. | 160/236 |
| 2,326,454 | 8/1943 | Gentile | 160/236 |
| 3,472,305 | 10/1969 | Lefes | 160/236 |
| 4,049,038 | 9/1977 | Hyman et al. | 160/236 |

FOREIGN PATENT DOCUMENTS

| | | | |
|---|---|---|---|
| 957124 | 8/1949 | France | 160/236 |

*Primary Examiner*—Peter M. Caun

*Attorney, Agent, or Firm*—Gordon L. Peterson

[57] ABSTRACT

A vertical louver system comprising a vertical louver support system and a plurality of vertical louvers mounted on the vertical louver support system. Each of the louvers includes a channel having first and second in-turned flanges and a web joining the flanges. An insert is received within the flanges and has reusable adhesive on its outer face to permit a decorative sheet to be attached to the insert. The insert and channel are resiliently bendable but are constructed to provide a strong composite structure which resists warping due to thermal conditions.

9 Claims, 6 Drawing Figures

VERTICAL LOUVER SYSTEM

BACKGROUND OF THE INVENTION

A vertical louver system is one form of window or door covering in which a series of vertical louvers are suspended from a vertical louver support system. A vertical louver system can be used across a window, door or other area and can be drawn like a drape so that it covers all, a portion, or none of the window area. When the vertical louvers are pulled across a window, they can be rotated about vertical axes to admit or exclude light.

Vertical louver systems can be used in many different ambient environments. However, when they are used in hot climates which provide strong solar loads, such as many desert regions, the individual louvers tend to warp or bend about a generally transverse axis. This is unsightly and can reduce the louver's effectiveness in excluding light and solar energy from the space in which they are used.

Hyman et al., U.S. Pat. No. 4,049,038 discloses a vertical louver system which includes a plastic panel, a backing sheet within the panel and a decorative member, such as wallpaper glued to the sheet. This construction does not provide adequate resistance to warping of the louvers, particularly when used in desert climates. Moreover, the affixing of the wallpaper to the sheet is accomplished with glue. This means that to change wallpaper, it is necessary to replace the backing sheet and the wallpaper thereby adding to the cost of redecorating.

SUMMARY OF THE INVENTION

This invention provides a vertical louver system which overcomes the disadvantages noted above. This invention can be advantageously embodied in a vertical louver system which comprises a vertical louver support system, a plurality of vertical louvers and means for mounting the vertical louvers on the vertical support system. At least one of the vertical louvers includes a channel and a panel-like insert. The channel includes first and second in-turned flanges and a web joining the flanges. The first flange and the web define a first elongated receiving zone and the second flange and the web define a second elongated receiving zone. The insert is received within the first and second receiving zones and is attached to the channel. Receiving zones of other configurations can be used.

To reduce the likelihood of warpage, the insert and the channel are constructed so as to have different bending characteristics about a transverse axis. More particularly, the insert is resilient and has sufficient rigidity such that it has a tendency to bend into a relatively sharp curve about a transverse axis in response to bending loads. The channel on the other hand tends to resiliently bend about a transverse axis into a more gradual curve in response to bending loads. With the insert attached to the channel, the composite structure provides substantial resistance to bending and warping even when subjected to severe solar energy loads, such as occur in the American desert during the summer.

The insert tends to bend into the relatively sharp curve with a snap action and tends, in effect, to be bistable. The insert is preferably curved in transverse cross section when it is in an unrestrained condition. In addition, the insert is preferably constructed of a metal such as steel or tempered aluminum.

The channel on the other hand can be constructed essentially in accordance with the prior art and may be, for example, constructed of a suitable plastic material, such as polyvinylchloride. When constructed in this fashion the channel bends more gradually and does not tend to be bistable. Accordingly, by utilizing a composite structure comprised of elements which can be individually bent relatively easily, the composite structure becomes much stronger than would be expected against bending loads.

This invention also provides advantageous ways of attaching the insert to the channel. With the insert received by the receiving zones, the insert is, of course, retained against transverse movement. With this invention, the insert is prevented from falling out of the channel by cooperation between the insert and the receiving zones which frictionally at least assist in attaching the insert to the channel. This can be accomplished, for example, by providing the insert with a transverse dimension in its unrestrained condition which exceeds the transverse distance provided by the receiving zones of the channel. With this construction, the insert must be resiliently deflected about its longitudinal axis when it is received by the receiving zone.

Alternatively or in addition to the frictional retention of the insert, reusable adhesive may be employed adjacent the lower ends of the insert and the channel for attaching the insert to the channel. If desired, velcro strips may be used adjacent the lower ends of the insert and the channel in lieu of the reusable adhesive.

One way to mount the channel on the vertical louver support system is to provide an opening adjacent the upper end of the channel and a mounting member which extends through the opening. If desired, an aperture may be provided through the insert and any decorative covering on the insert, and the mounting member may extend through this aperture. This allows maximum coverage of the channel by the insert and the decorative sheet and conveniently accommodates the mounting member for attaching the louver to the vertical support system. In addition the mounting member attaches the insert to the channel. Each of the attaching means for the insert and channel allows for easy removal of the insert from the channel.

The insert has an outer face which preferably has reusable adhesive for attaching a decorative covering to the insert. This allows even an unexperienced person to attach wallpaper to the insert and it facilitates redecorating.

The invention, together with further features and advantages thereof, may best be understood by reference to the following description taken in connection with the accompanying illustrative drawing.

DESCRIPTION OF THE PREFERRED EMBODIMENT

Figure 1A:
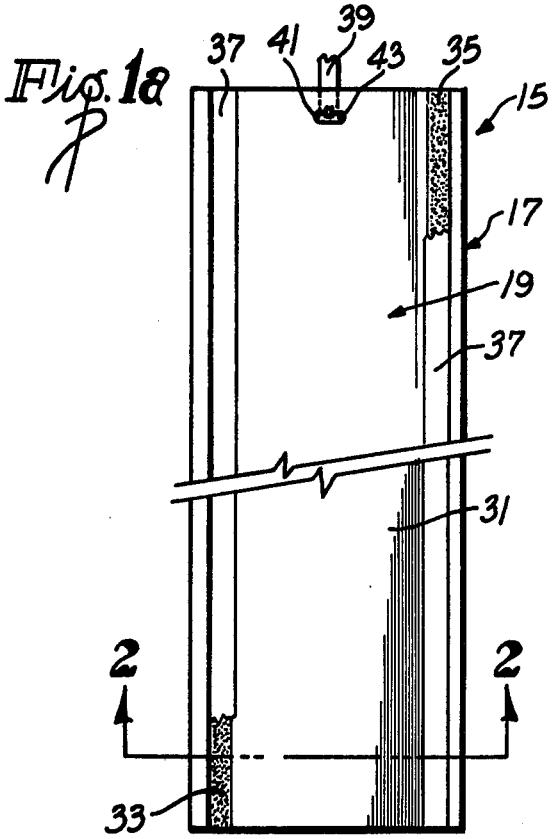
FIG. 1*a* is an elevational view of one of the vertical louvers constructed in accordance with the teachings of this invention, with portions broken away.
Figure 1:
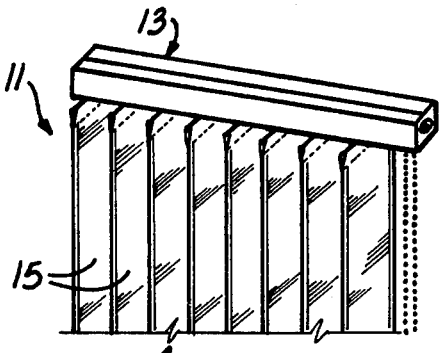
FIG. 1 is a fragmentary perspective view of a vertical louver system constructed in accordance with the teachings of this invention.
Figure 5:
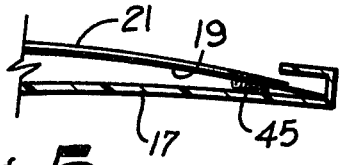
FIG. 5 is an enlarged fragmentary sectional view taken generally along line 5—5 of FIG. 4.

FIG. 1 shows a vertical louver system 11 which includes a vertical louver support system 13 of conventional construction and a plurality of vertical louvers 15. The vertical louver support system 13 suspends the vertical louvers 15 and permits the louvers to be drawn in the direction of the double arrow in FIG. 1 so as to cover or uncover a window or other similar area. In addition, the vertical louver support system allows each of the vertical louvers 15 to be pivoted about its longitudinal vertical axis to provide varying degrees of exposure to outside illumination. Because the vertical louver support system 13 is known per se, it is not described in detail herein.

Figure 3:
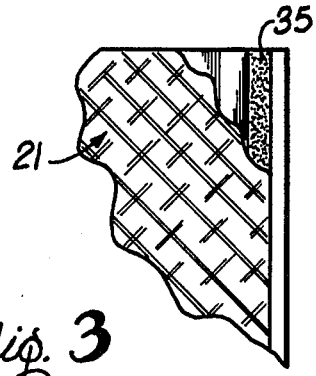
FIG. 3 is a fragmentary, elevational view with portions broken away showing a vertical louver having wallpaper adhered to the outer face of the insert.
Figure 2:
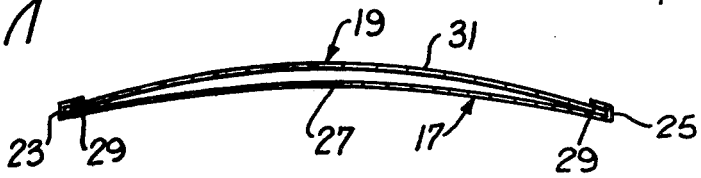
FIG. 2 is an enlarged, sectional view taken generally along line 2—2 of FIG. 1.

FIG. 1*a* shows one of the louvers 15, and this louver includes a channel 17 and a panel-like insert 19. In addition, the vertical louver 15 may also include a decorative sheet or covering, such as wallpaper 21 (FIG. 3). The channel 17 in the embodiment illustrated is conventional and is constructed of a suitable plastic material, such as polyvinylchloride. The channel 17 includes opposite flanges 23 and 25 (FIG. 2) integrally joined by a web 27. The web 27 may be curved slightly as viewed in transverse cross section (FIG. 2). The flanges 23 and 25 are in-turned so that they project toward each other. The flanges 23 and 25 cooperate with adjacent regions of the web 27 to define receiving zones which, in the embodiment illustrated, are elongated slots 29. The channel 17 is preferably extruded, and accordingly, the cross section shown in FIG. 2 is typical and extends continuously throughout the full length of the channel.

The insert 19 is in the form of a panel, and in the embodiment illustrated, is substantially co-extensive with the channel 17. The insert 19 is preferably constructed of tempered aluminum and is curved in transverse cross section as shown in FIG. 2. By way of example, the insert 19 may be about 0.020 inch thick aluminum or it may be roll formed steel.

The channel 17 and the insert 19 are constructed so that they have different deflection characteristics when bending loads are applied tending to bend each of them about a transverse axis. The channel 17 tends to bend relatively evenly and smoothly when transverse bending loads are applied to its opposite ends. By way of constrast, the insert 19 tends to be bistable and snaps into a relatively sharp bend when transverse bending loads are applied to its opposite ends. Various different constructions which provide these different deflection characteristics in response to transverse bending loads can be utilized. However, the construction shown is preferred. The composite structure of the channel 17 and the insert 19 afford substantial strength against bending and warping.

The insert 19 has an outer face 31 which in the embodiment illustrated, is convex. Although the outer face 31 may itself be decorative and the release paper 37 can be decorative, typically the adhesive strips 33 and 35 are provided to facilitate the attachment of the wallpaper 21 or similar decorative sheet to the outer face 31 as shown in FIG. 3. The reusable adhesive strips 33 and 35 are provided along the opposite longitudinal edge portions of the outer face 31, and each of these strips is covered with a strip of silicone release paper 37. If desired, the release paper 37 can be removed, and the wallpaper 21 or other decorative layer may be adhered to the outer face 31 by the adhesive strips 33 and 35. The adhesive strips 33 and 35 are reusable so that the wallpaper 21 can be peeled off of the insert 19 and new wallpaper applied, and this makes the insert 19 reusable.

In use, the upper end of the insert 19 can be slid into the slots 29 and slid upwardly to the position shown in FIG. 1*a*. The transverse dimension of the insert 19 exceeds the transverse dimension between the ends of the flanges 23 and 25 so that additional curvature is imparted to the resilient insert 19 about its longitudinal axis. The force of friction between the insert 19 and the flanges 23 is sufficient to retain the insert 19 within the channel 17 and to prevent the insert from sliding downwardly in the channel. This eliminates the need for separate attaching means between the channel 17 and the insert 19 and provides for automatic attachment between these two members as a function of the sliding of the insert to the correct position within the channel. This method of attachment also permits relative movement between the channel 17 and the insert 19 as a result of differential thermal expansion when the vertical louver 15 is heated by the sun.

The channel 17 may be suspended from the vertical louver support system 13 in a conventional manner, such as by a mounting member in the form of a clip 39 which extends through an opening 41 of the channel 17. To enable the insert 19 to cover all of the channel 17 and not to interfere with the clip 39, the insert 19 has an aperture 43 in registry with the opening 41 which also receives the clip 39 to attach both the channel 17 and the insert 19 to each other and to the support system 13. If desired, the wallpaper 21 can be slit so that it also accommodates the clip 39. The opening 41 and the aperture 32 are oversized relative to the clip 39 so that the clip 39 does not interfere with relative thermal expansion of the channel 17 and the insert 19.

Figure 4:
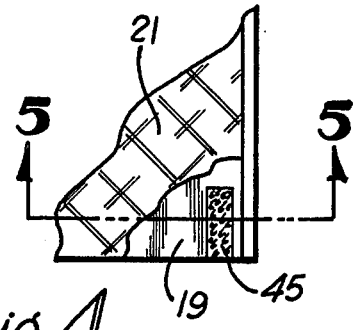
FIG. 4 is a fragmentary elevational view of a vertical louver with portions broken away illustrating an alternate means for attaching the insert to the channel.

In lieu of or in addition to frictionally retaining the insert 19 as shown in FIGS. 1*a*–3, or using the clip 39 to attach the panel 17 to the insert 19, the insert 19 may be retained by reusable adhesive strips 45 (only one being shown in FIG. 4) provided on the channel 17 near the lower edge of the channel. Preferably two of the strips 45 are provided adjacent the opposite longitudinal edges of the insert 19, respectively. Alternatively, the strips 45 may be velcro carried by the channel 17 and the insert 19.

Although exemplary embodiments of the invention have been shown and described, many changes, modifications and substitutions may be made by one having ordinary skill in the art without necessarily departing from the spirit and scope of this invention.

I claim:

1. A vertical louver system comprising:

a plurality of vertical louvers;

means for mounting said vertical louvers on said vertical louver supporting system;

at least one of said vertical louvers including a channel and a panel-like insert;

said channel including first and second flanges and a web joining said flanges, said first flange and said web defining a first elongated receiving zone and said second flange and said web defining a second elongated receiving zone;

said insert being curved in transverse cross section when the insert is in an unrestrained condition;

said insert being resilient and having sufficient rigidity such that it has a tendency to bend into a relatively sharp curve about a transverse axis with snap action in response to bending loads about such axis and said channel tending to bend about a tranverse axis into a more gradual curve in response to bending loads about such axis whereby said insert and said channel have different bending characteristics when bent separately about a transverse axis;

said insert being received in said first and second receiving zones; and means for attaching said insert to said channel.

2. A vertical louver system as defined in claim 1 wherein said insert has an outer face and reusable adhesive on said outer face whereby a decorative sheet can be attached to and removed from said outer face.

3. A vertical louver system as defined in claim 1 wherein said attaching means includes said insert and said receiving zones cooperating to frictionally at least assist in attaching the insert to the channel.

4. A vertical louver system as defined in claim 1 wherein said attaching means includes an aperture in said insert, an opening in said channel and a mounting member, said mounting member extends through said aperture and said opening, said mounting member also at least assisting in mounting said one louver on a support system.

5. A vertical louver system as defined in claim 1 wherein said attaching means includes means adjacent the lower ends of the insert and the channel for attaching the insert to the channel.

6. A vertical louver system as defined in claim 1 wherein said channel is constructed of a plastic material, said insert is constructed of tempered aluminum or rolled steel.

7. A vertical louver system as defined in claim 6 wherein said insert has an outer face and reusable adhesive on said outer face whereby a decorative sheet can be attached to and removed from said outer face, said attaching means including said insert having a transverse dimension in its unrestrained condition which exceeds the transverse distance provided by the receiving zones of the channel, said insert being resiliently deflected about said longitudinal axis when it is received by said receiving zones whereby to at least assist in attaching the insert to the channel.

8. A vertical louver system as defined in claim 1 wherein said insert is spaced from said channel in a region intermediate said receiving zones.

9. A vertical louver system as defined in claim 1 wherein said channel is curved in transverse section with the curvatures of the insert and channel being convex in the same direction such as to space the channel and the insert in a region intermediate said zones.

* * * * *